United States Patent [19]

Wuschek

[11] Patent Number: 4,473,011

[45] Date of Patent: Sep. 25, 1984

[54] CIRCULATING AERIAL ROPEWAY AND CAR THEREFOR

[75] Inventor: Manfred Wuschek, Cologne, Fed. Rep. of Germany

[73] Assignee: PHB Weserhutte AG, Cologne, Fed. Rep. of Germany

[21] Appl. No.: 358,057

[22] Filed: Mar. 15, 1982

[30] Foreign Application Priority Data

Mar. 14, 1981 [DE] Fed. Rep. of Germany ..... 3109944

[51] Int. Cl.[3] ..... B61B 7/02

[52] U.S. Cl. ..... 104/173 R; 104/99; 104/112; 105/148; 198/473; 198/681

[58] Field of Search ..... 104/173 R, 112, 87, 104/89, 96, 99; 105/148; 198/473, 681

[56] References Cited

U.S. PATENT DOCUMENTS

| | | | |
|---|---|---|---|
| 538,202 | 4/1895 | Swem | 104/173 R |
| 1,109,371 | 9/1914 | Thunhart | 104/87 |
| 1,259,620 | 3/1918 | Haalck | 104/87 |
| 2,682,838 | 7/1954 | Dumur | 104/87 X |
| 3,986,601 | 10/1976 | Ulrich | 104/173 R X |

FOREIGN PATENT DOCUMENTS

| | | | |
|---|---|---|---|
| 317995 | 9/1974 | Austria . | |
| 558894 | 5/1960 | Belgium . | |
| 511527 | 2/1931 | Fed. Rep. of Germany | 104/99 |
| 798639 | 12/1950 | Fed. Rep. of Germany . | |
| 858706 | 12/1952 | Fed. Rep. of Germany . | |
| 756899 | 3/1953 | Fed. Rep. of Germany | 104/173 R |
| 916059 | 8/1954 | Fed. Rep. of Germany . | |
| 2150939 | 4/1973 | Fed. Rep. of Germany . | |
| 1249949 | 11/1960 | France | 104/173 R |

OTHER PUBLICATIONS

Ing. Manfred Wuschek—Die Stellung der Material--Drahtseilbahnen unter den modernen Fordermitteln; fordern und heben 1966, Heft 8, 649–653.

Materials Handling News, Sep. 1979; "When the Going3 s Rough, Rise Above It"; pp. 43, 45, 47.

*Primary Examiner*—Randolph Reese

*Attorney, Agent, or Firm*—Fleit, Jacobson, Cohn & Price

[57] ABSTRACT

A circulating aerial ropeway for conveying material such as loose or bulk goods has individual cars for conveying the material, each car being pivotally borne between two longitudinal carrying beams for swinging movement about a transverse, substantially horizontal axis which is above the center of gravity of the car, the car thereby being free-hanging and arranged always to assume a substantially horizontal position, each carrying beam mounting running wheels, the ropeway also having at least two laterally-spaced, parallel track ropes, a track rope being on each side of each car so that the running wheels run on the track ropes, and at least two laterally-spaced, parallel hauling ropes, a hauling rope being on each side of each car the cars having jaws for coupling the hauling rope to the car.

11 Claims, 11 Drawing Figures

CIRCULATING AERIAL ROPEWAY AND CAR THEREFOR

BACKGROUND OF THE INVENTION

The present invention relates to a circulating aerial ropeway for conveying material such as loose or bulk goods, the ropeway comprising individual cars acting as individual conveying units for conveying the material, and track and hauling ropes arranged parallel to one another in the longitudinal conveying direction. The cars have containers for the material and running wheels for running along the track rope; the hauling rope is connected to the cars by coupling means. The circulation is horizontal, i.e. the start and finish are spaced apart horizontally, even though there may be a considerable change in altitude.

Circulating aerial ropeways have been known for a long time, and in general terms, they operate according to a single rope system (acting both as track rope and hauling rope) or as a two-rope system in which the track rope serves as the running track and the hauling rope moves the cars from a loading station to an unloading station and back. If the conveying path is long, it can be divided into a number of hauling rope sections and/or track rope sections.

There are articles describing circulating aerial ropeways in "Fördern und Heben", 1966, pages 649 to 653 and in "Materials Handling News", September 1979, pages 43 to 47. As a matter of terminology, they can be called circulating aerial cableways and the term "cable" be used instead of "rope".

In uncouplable aerial ropeways, the coupling means comprise means for coupling and uncoupling the cars to and from the hauling rope, and the hauling rope or hauling and track rope circulates continuously. When the cars are uncoupled, normally at the stations, they are free of the hauling rope, and the arrangement is normally such that the cars are automatically coupled to the hauling rope prior to leaving a station and are automatically uncoupled from the hauling rope on entering a station. If desired, rails can serve as track for the cars in the stations. Thus for loading or unloading, or for checking or repairing the rail track at the stations, the cars can be uncoupled, and the cars can also be moved to repairing or storage tanks.

In previous uncouplable circulating aerial ropeways, the car has a carriage which runs on the rails in the stations and in a two-rope system also runs on the track rope between stations; the car also has a suspension which is fixed by means of a pivot bolt to the carriage and the container of the car is carried on the lower end of the suspension; the coupling means often forms a unit with the carriage.

With known uncouplable aerial ropeways, rates of conveyance have usually been 650 tons per hour or less. Although higher rates of conveyance are desirable, they cause difficulty. On the one hand, the time interval between cars cannot be too short. On the other hand, heavier loadings on the individual cars and also shorter spacings require rope sizes and weights which can become impracticable. With aerial ropeways with rates of conveyance above about 400 tons per hour, the track ropes are already so heavy that even if there is sufficient space available, transport and installation are lengthy and costly operations which consume a lot of energy. The hauling ropes have their dimensions limited for the same reasons as the track ropes, and higher rates of conveyance can lead to short hauling rope sections which are not satisfactory both economically and technically.

German patent specification No. 21 50 939 suggests a combination of ropeway and continuous conveyor; however one would expect complex difficulties and rough operation. The ropeway suggested in German patent specification No. 858 706 would have similar problems. Both suggestions have not been adopted in practice.

The invention is based on the appreciation that it is desirable to provide a circulating aerial ropeway of relatively light construction which can achieve substantially higher rates of conveyance than 400 or 650 tons per hour, for instance up to 2,500 tons per hour.

THE INVENTION

In accordance with the invention, each container is pivotally borne between two longitudinal carrying beams for swinging movement about a transverse, substantially horizontal axis which is above the center of gravity of the container, the container thereby being free-hanging and arranged always to assume a substantially horizontal position, each carrying beam mounting running wheels which will run along at least two laterally-spaced, parallel track ropes, a track rope being on each side of each container; there are also at least two laterally-spaced, parallel hauling ropes, a hauling rope being on each side of each car and coupled to the container by coupling means. The present invention also provides the car itself.

By having at least two track ropes and at least two hauling ropes, there is a division of the earlier single track rope and single hauling rope into a number of units, enabling the dimensions and weight of the ropes to be significantly reduced in relation to the rates of conveyance.

A free-hanging container ensures a constant vertical position for the conveying containers, whether the track rope is horizontal or inclined, and this enables all the cars to be filled to the maximum extent.

The present invention can provide the following:

(a) conveyance of material such as loose or bulk goods over large distances;

(b) the possibility of installing the ropeway in difficult mountainous terrain where large inclinations of the track are required;

(c) as heavy and voluminous track and hauling ropes are not required, transport and assembly difficulties are reduced in every type of terrain;

(d) the cars can be relatively light and dead weights relatively low;

(e) section lengths of track and hauling ropes can be relatively large, thus lowering installation and running costs;

(f) the car load can be distributed substantially equally on all of a relatively large number of running wheels, independent of track inclination and container filling;

(g) the hauling ropes can be coupled to the cars at such a position that there is substantially equal loading of all the running wheels under all operating conditions;

(h) the free-swinging containers permit full exploitation of the volume of the containers, independent of track inclination;

(i) the cars can be unloaded between stations; and (j) the hauling ropes can be positioned such that they are not dirtied for instance by conveyed material falling over the edge of the car.

DESCRIPTION OF PREFERRED EMBODIMENT

The invention will be further described, by way of example, with reference to the accompanying drawings, in which.

Figure 1:
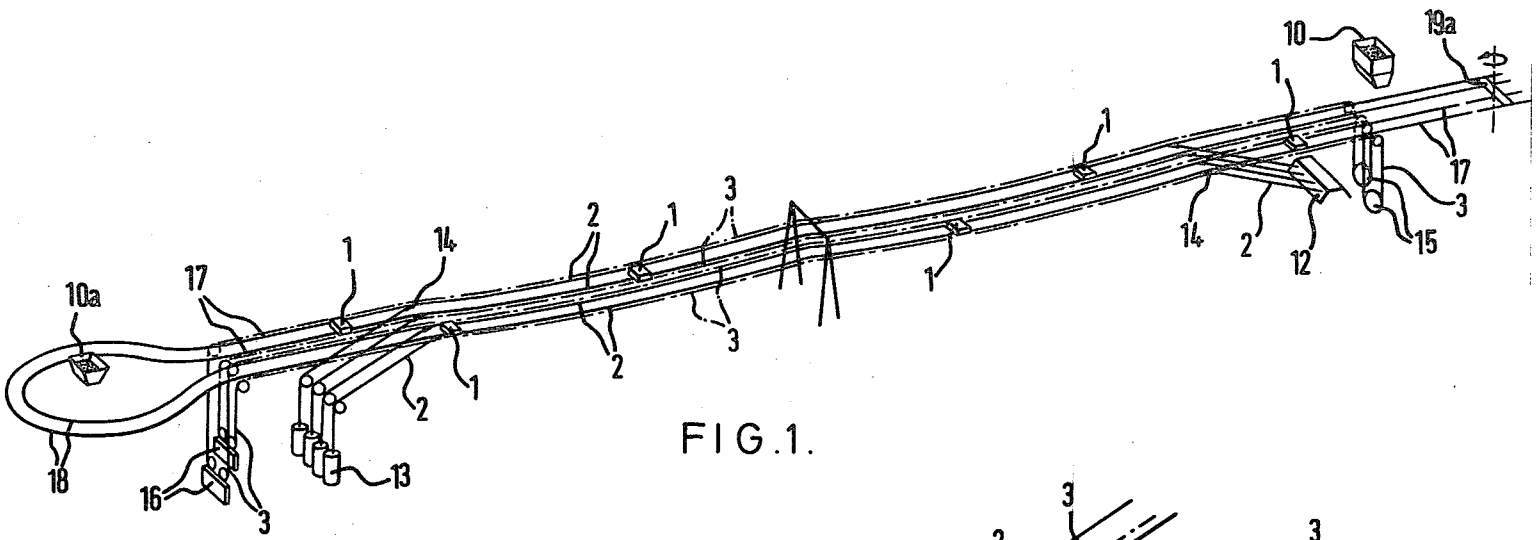
FIG. 1 is a schematic, perspective view of a circulating aerial ropeway in accordance with the invention.
Figure 2:
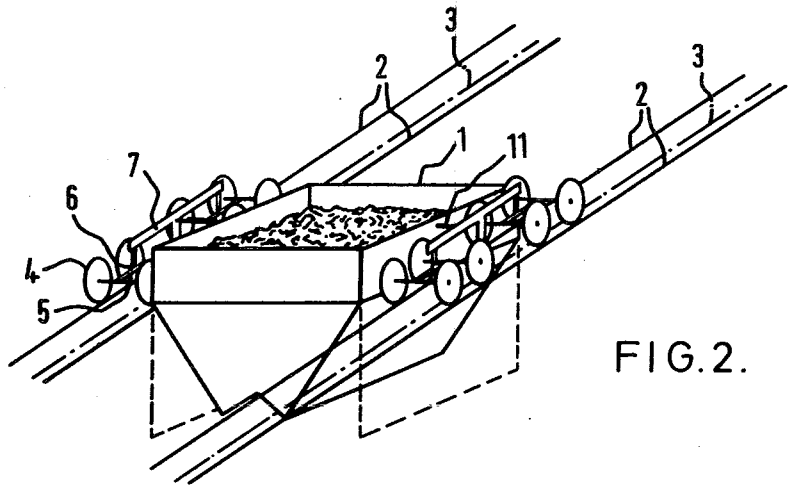
FIG. 2 is a perspective view showing a section of the track ropes and a car, partly schematically, on a larger scale than that in FIG. 1.

The uncouplable, circulating aerial ropeway is for conveying material such as loose, particulate or bulk goods by means of cars having containers 1. The tracks for the containers 1 are formed by longitudinal track ropes 2 of which there are two on each side of each container 1. There are hauling ropes 3, in this case one hauling rope 3 on each side of each container 1 and between and slightly above the track ropes 2. The general circulation of the cars is horizontal, in the sense that a long horizontal distance is traversed, although this may be associated with substantial changes in altitude. There are conventional supports such as masts for supporting the track and hauling ropes 2, 3 and allowing circulation of the hauling ropes 3. Loading and unloading bunkers 10, 10*a* are shown in FIG. 1.

The containers 1 are constructed to hang free. The containers have pairs of laterally-spaced running wheels 4 which run on the pairs of track ropes 2 and which are journalled in longitudinal rocking bars 5, there being two running wheels 4 carried by each pair of rocking bars 5, i.e. a plurality of wheels 4 which are spaced apart in the direction of travel. In the center, half way between the axes of the respective running wheels 4, the rocking bars 5 are pivotally mounted by bearing blocks 5*a* (see FIG. 5), for instance by bolting the rocking bars 5 to the ends of splined cross-shafts 6. In this way, the rocking bars can rock about transverse, substantially horizontal axes.

Figure 3:
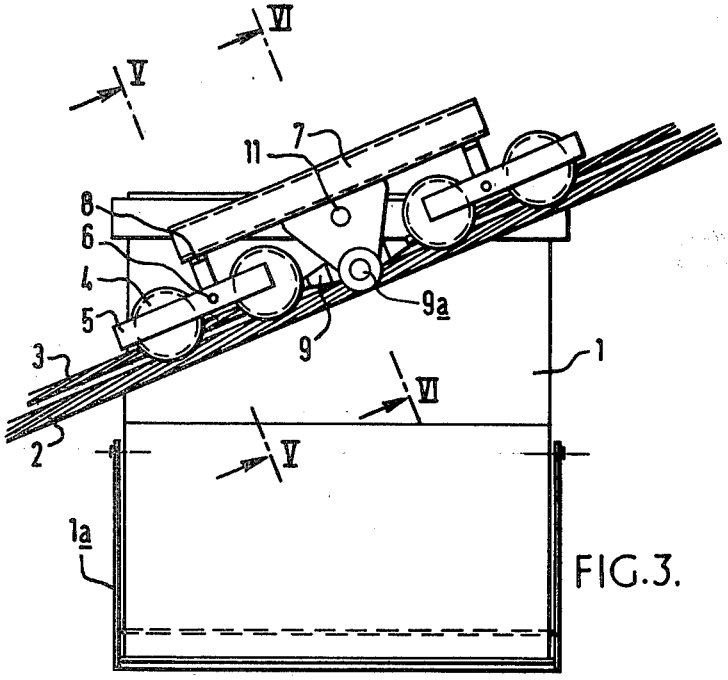
FIG. 3 is a side view of the car, with its suspension, on a somewhat larger scale than in FIG. 2.

The bearing blocks 5*a* are mounted on longitudinal side carrying beams 7 by means of vertical shanks 8 which are integral with the bearing blocks 5*a* and which can pivot with respect to the beams 5 about respective axes which are substantially vertical as seen looking in the direction of travel (as in FIG. 5) and which are substantially at right angles to the direction of travel as seen looking transversely (as in FIG. 3), thereby enabling the rocking bars 5 to swivel when the car is passing around bends. As can be seen in FIG. 3, the rocking bars 5 are arranged on each end of each side beam 7, and as can be seen in FIG. 5, the rocking bars 5 are in two side-by-side pairs.

Figure 6:
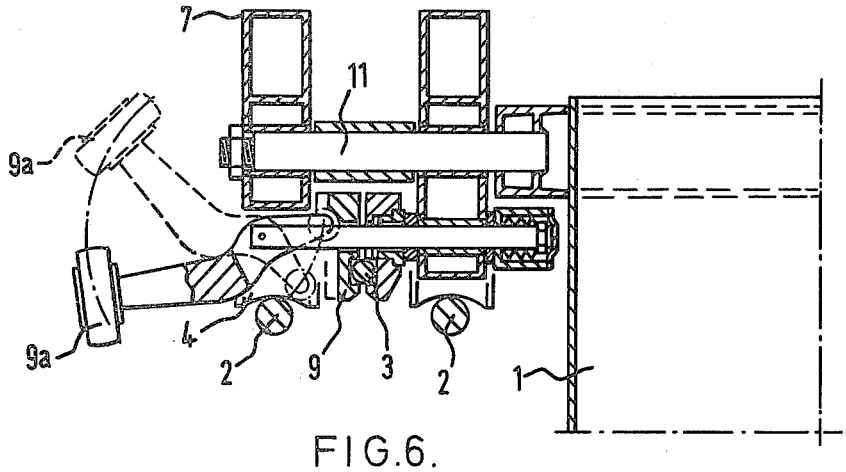
FIG. 6 is a corresponding section along the line VI—VI of FIG. 3.
Figure 7:
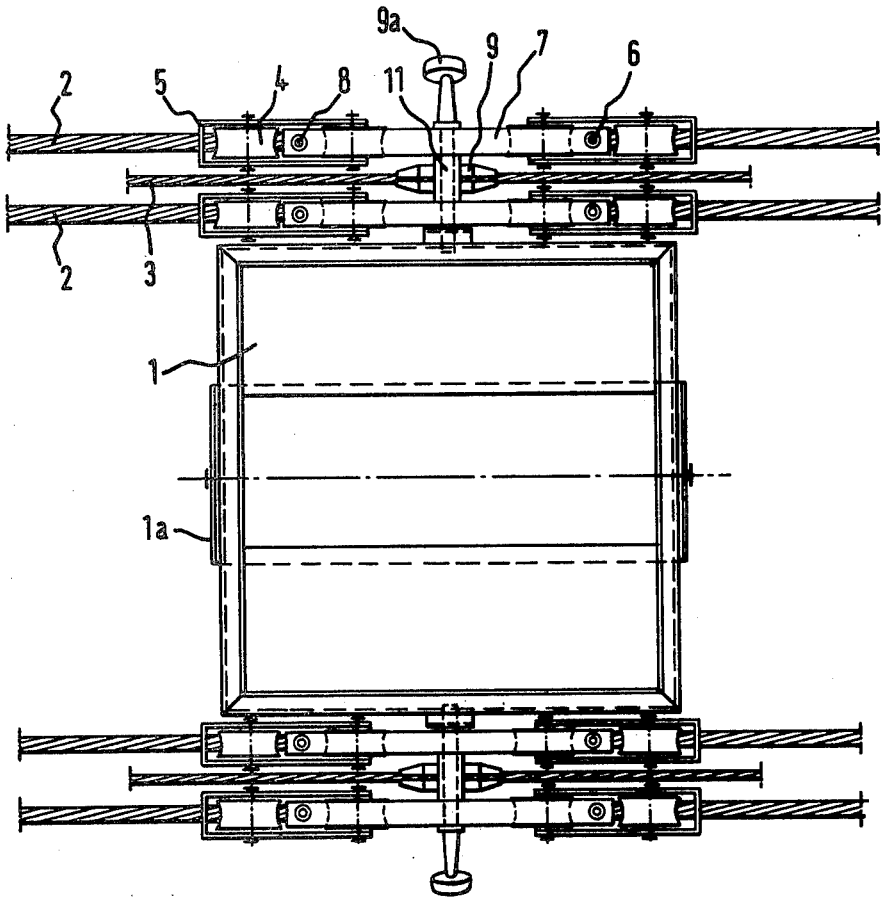
FIG. 7 is a plan view of a car, showing the track ropes and hauling ropes, on the same scale as FIG. 3.

Each container is pivotally borne between two pairs of adjacent side beams 7 by means of overhung bolts 11 (see FIG. 6). The axis of the bolt 11 is in the middle of the container 1 and above the center of gravity of the container 1, the container 1 therefore being pivotal about a transverse, substantially horizontal axis and being free-hanging with its opening uppermost, remaining in a constant horizontal position both on a horizontal track and also on an inclined track.

Figure 5:
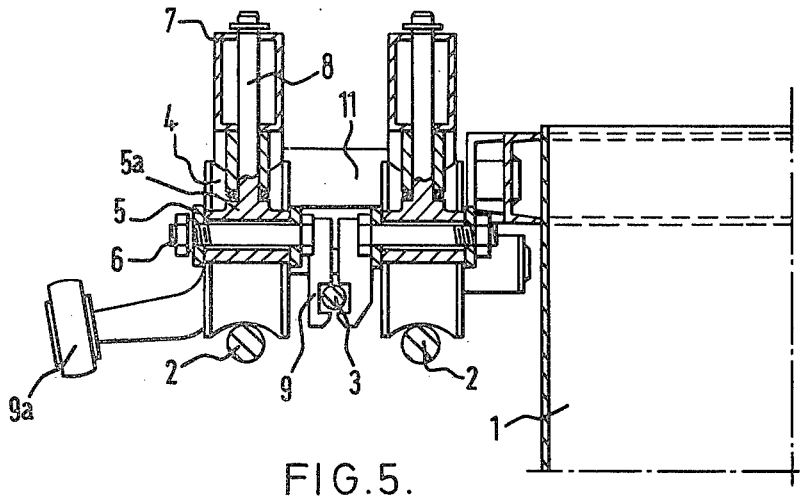
FIG. 5 is a section through part of the car, on a larger scale, along the line V—V of FIG. 3.

The car has coupling means in the form of at least one coupling device 9 for coupling and uncoupling the car to and from the laterally-spaced, parallel hauling ropes 3 (see FIGS. 5 and 6). In a manner known, the coupling device 9 has a cam head 9*a* for engagement with a cam track at the stations for automatic actuation of the coupling device 9. Further details of the coupling device 9 are shown in FIG. 6 including jaw members for engaging the hauling ropes 3, but specific description is not necessary.

It will be seen that the track ropes 2 are all laterally spaced from one another, and are in two pairs, one pair on either side of the container 1. The specific free-hanging arrangement of the container 1 requires the use of two laterally-spaced, parallel hauling ropes 3, one on either side of the container 1. The specific arrangement described for the twin hauling ropes 3 avoids any frame or the like around the container 1 in order to couple on a central hauling rope, and the spacing of the hauling ropes 3 from the sides of the container 1 avoids dirtying the hauling ropes 3 by falling material. Furthermore, the coupling of the hauling ropes 3 just slightly below the pivot axis of the bolts 9 between the track ropes 2 and the pivot axis gives a largely uniform loading of all the running wheels 4 under all operating conditions, the twin hauling ropes 3 on either side of the car avoiding unilateral traction.

Figure 4:
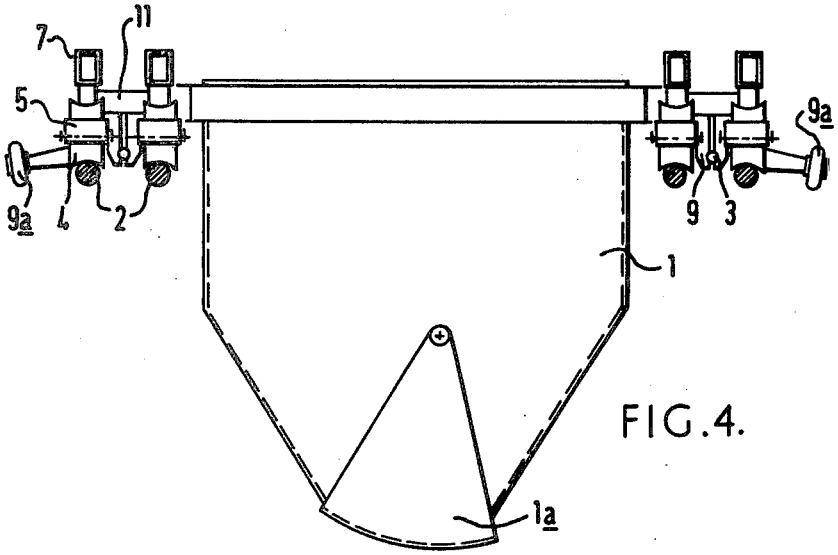
FIG. 4 is a front view of the car of FIG. 3.
Figure 8:
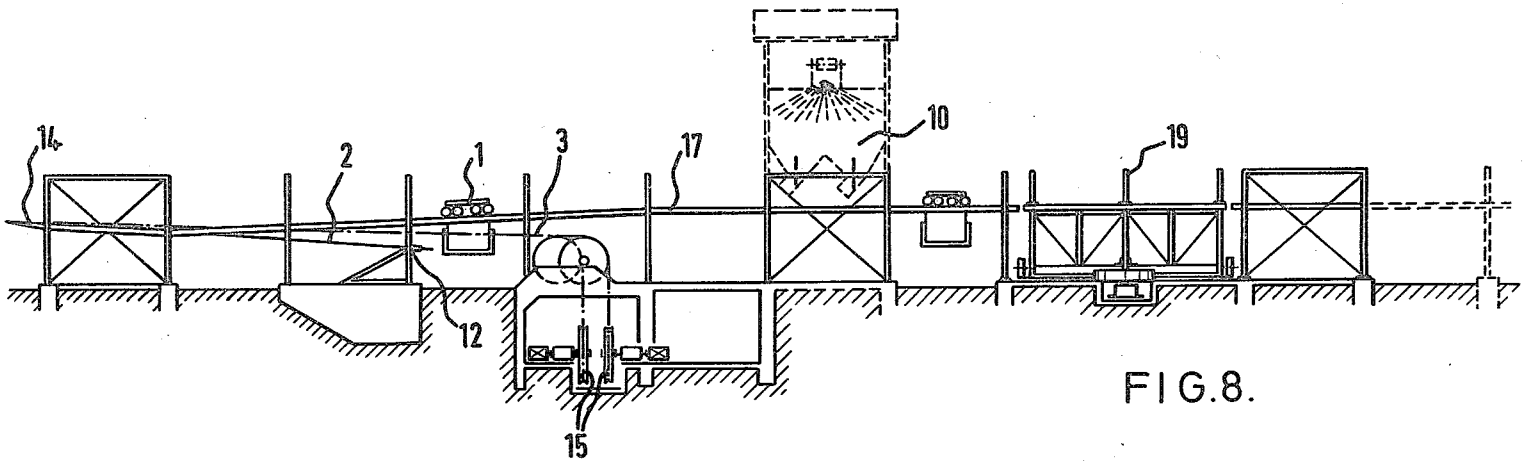
FIG. 8 is a side view of a loading station, on a smaller scale.

The pivotal bearing of the containers 1 in the side beams 7 by means of the bolts 11 distributes the load of the container 1 more or less uniformally onto all the running wheels 4, independently of track inclination and car filling. The free-swinging containers 1 allow any desired track inclinations to be travelled along. However, the containers 1 can be unloaded between stations, for instance in a conventional manner by swinging an unloading flap 1*a* (see FIGS. 3 and 4). At the ends of the track sections or at the ends of the aerial ropeway, the track ropes 2 are connected to metal guide shoes 14 (see FIGS. 8 and 10) at the station run-in or run-out; the track ropes 2 continue on beyond the guide shoes 14 and are connected to anchoring devices 12 (FIG. 8) and/or tensioning devices 13 (FIG. 10).

Figure 10:
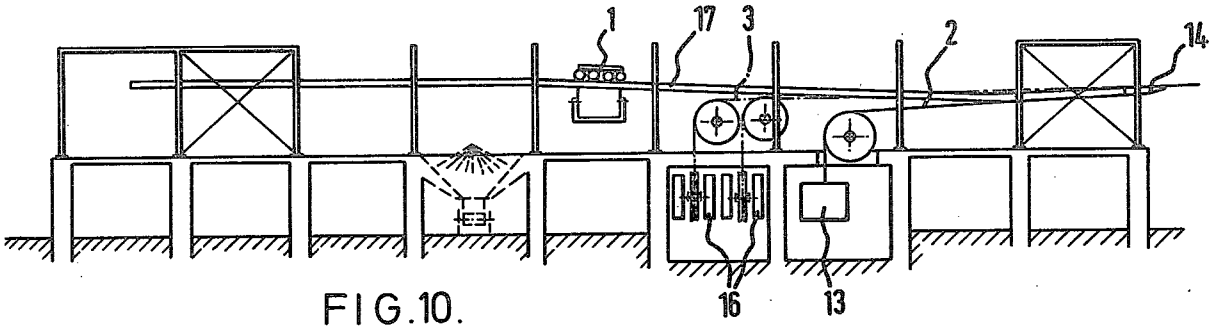
FIG. 10 is a side view of an unloading station.

In the same zones, the hauling ropes 3 are guided downwards to a drive mechanism 15 (FIG. 8) and/or tensioning devices 16 (FIG. 10).

Figure 9:
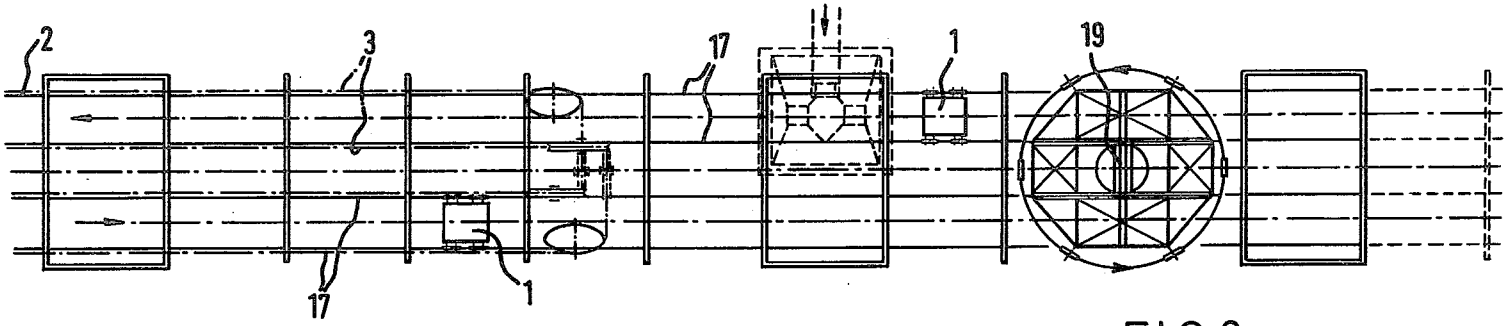
FIG. 9 is a plan view of the loading station of FIG. 8.
Figure 11:
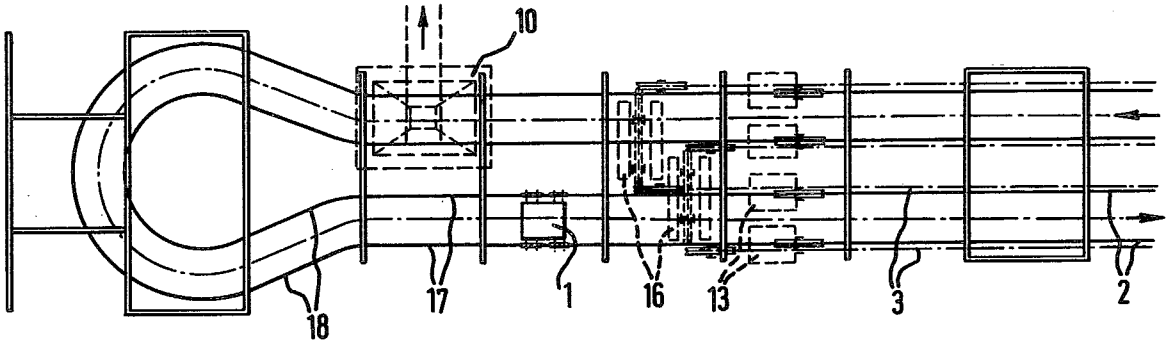
FIG. 11 is a plan view of the unloading station of FIG. 10.

The guide shoes 14 lead to fixed rails 17, which are provided both in the end sections of the aerial ropeway and at stations and serve as two parallel fixed tracks for the car running wheels 4, the rails 17 acting as direct longitudinal extensions of the track ropes 2. At the very end sections of the ropeway, the fixed rails can form an end loop 18 for guiding the cars round the end and back in the opposite direction (FIG. 11); alternatively, a turntable 19 (FIGS. 8 and 9) or transversely-sliding platform 19*a* (FIG. 1) can be provided for the same purpose, to transfer the cars from one track to the adjacent, parallel, return track.

The invention provides the technical advantage that, relative to the rate of conveyance, heavy and voluminous track and hauling ropes can be avoided; furthermore, the omission of the original bulky suspension allows relatively heavy conveying containers 1 to be mounted on the running wheels 4 without the incorporation of very heavy individual suspension system parts.

The free-hanging arrangement of the containers 1 has the following advantages:

a. the cars can be of compact construction, saving weight and cost and also enabling other parts of the ropeway to be reduced in size and weight;

b. the cars cannot swing transversely, enabling the track ropes 2 of the laden and unladen cars to be closer together, and hence enabling carrying mast heads to be more compact and stations to be narrower, reducing weight and costs; furthermore, this enables the speed to be increased, thus reducing the number of cars, reducing the load on each stretch between stations, lowering hauling rope tensions or allowing greater lengths of hauling rope sections, and avoiding the problem of having to bring transversely swinging cars into a central position with guides and avoiding the impacts on the guides which in turn cause the speed of travel to be limited.

c. the masts or supporting structure for the rails 17 in the stations can extend vertically downwards so that it is not necessary to pass the load of the rails through the station building, enabling a further weight and cost saving to be made.

It is believed that using the invention, relatively problem-free conveyance can be provided at rates of conveyance which are a multiple of those generally possible with previous ropeways of a similar kind.

I claim:

1. A circulating aerial ropeway for conveying material such as loose or bulk goods, comprising:

at least two laterally-spaced, parallel track ropes;

at least two laterally-spaced, parallel hauling ropes;

driving means for moving the hauling ropes longitudinally;

individual cars each comprising a container for said material, two longitudinal carrying beams one on each side of each said container, pivot means pivotally mounting each said container between and on two respective said carrying beams for swinging movement about a transverse, substantially horizontal axis, said axis being above the center of gravity of the respective said container, said container thereby being free-hanging and arranged substantially always to assume a substantially horizontal position, a plurality of longitudinally-spaced longitudinal rocking bars pivotally mounted on each said carrying beam for relative rocking movement about transverse substantially horizontal axes, a plurality of running wheels rotatably mounted on said rocking bars and running on respective said track ropes, said track ropes being on either side of said container, and uncouplable coupling means for coupling and uncoupling said car to said hauling ropes, said coupling means comprising hauling rope engaging members on either side of said container, said hauling ropes, being on either side of said container.

2. The ropeway of claim 1, wherein said rocking bars are pivotally mounted on respective said carrying beams for movement about respective axes which are substantially vertical as seen looking in the direction of travel and which are substantially at right angles to the direction of travel as seen looking transversely, thereby enabling said rocking bars to swivel when said container is passing around bends.

3. The ropeway of claim 1, wherein each said rocking bar mounts a plurality of running wheels which are spaced apart in the direction of travel, and wherein each said carrying beam mounts a plurality of said rocking bars which are spaced apart in the direction of travel.

4. The ropeway of claim 1, wherein there are two laterally-spaced, parallel said track ropes on each side of each said container, there being pairs of laterally-spaced said running wheels on each side of each said container, for running on said track ropes, a said hauling rope being between said track ropes on each side of said container, as seen looking downwards, and said hauling rope being between said pivot means and said track ropes, as seen looking transversely.

5. The ropeway of claim 1, wherein said coupling means on each side of each said container is adjacent said transverse, substantially horizontal axis about which said container can swing.

6. The ropeway of claim 1, and further comprising at the end thereof or at the end of a track section thereof guide shoes to which said track ropes are connected and beyond which said track ropes are inclined downwards, and tension applying means connected to the ends of said track ropes beyond said guide shoes.

7. The ropeway of claim 1, and further comprising, at the end thereof or at the end of a track section thereof, tension applying means and means guiding said hauling ropes downwards to said tension applying means.

8. The ropeway of claim 1, and further comprising, at the end thereof or at the end of a track section thereof, fixed rails for acting as an extension to said track ropes as a track for said running wheels.

9. The ropeway of claim 8, wherein, at at least one end thereof, said fixed rails form two parallel tracks, the ropeway further comprising a loop rail interconnecting said tracks.

10. The ropeway of claim 9, wherein, at at least one end thereof, said fixed rails form two parallel tracks, the ropeway further comprising a turntable for transferring said containers between said tracks.

11. The ropeway of claim 8, wherein, at at least one end thereof, said fixed rails form two parallel tracks, the ropeway further comprising a transversely-sliding transfer platform for transferring said containers between said tracks.

* * * * *